United States Patent [19]

Ivanov et al.

[11] Patent Number: 4,871,294

[45] Date of Patent: Oct. 3, 1989

[54] AXIAL-FLOW FAN

[76] Inventors: Sergei K. Ivanov, ulitsa Artema, 102b, kv. 44.; Viktor E. Dudkin, ulitsa Avtotransportnikov, 1, kv. 72.; Valery P. Peredery, prospekt Dzerzhinskogo, 6, kv. 88.; Viktor N. Molchanov, prospekt Semashko, 26, kv. 42., all of Donetsk, U.S.S.R.

[21] Appl. No.: 508,241

[22] Filed: Jun. 27, 1983

[30] Foreign Application Priority Data

Jun. 29, 1982 [SU] U.S.S.R. ..... 3465201
Feb. 2, 1983 [SU] U.S.S.R. ..... 3539801

[51] Int. Cl.[4] ..... F04D 29/66

[52] U.S. Cl. ..... 415/58.7; 415/914; 415/58.4

[58] Field of Search ..... 415/53 R, 144, 191, 415/207, 213 C, DIG. 1, 199.5, 185, 208

[56] References Cited

U.S. PATENT DOCUMENTS 3,189,260 6/1965 Ivanov ..... 415/191
3,640,638 2/1972 Britt et al. ..... 415/199.5 X

FOREIGN PATENT DOCUMENTS 110800 7/1982 Japan ..... 415/53 R
45457 4/1939 Netherlands ..... 415/DIG. 1
488310 10/1974 U.S.S.R. ..... 415/DIG. 1
2124303B 2/1984 United Kingdom .

OTHER PUBLICATIONS

"New Axial-Flow Fans Without Unstable Operating Areas" by H. D. Henssler, VGB Kraftwerkstechnik, A Special Issue: 3/77; pp. 159-165.

*Primary Examiner*—Robert E. Garrett
*Assistant Examiner*—Joseph M. Pitko
*Attorney, Agent, or Firm*—Lilling & Greenspan

[57] ABSTRACT

An axial-flow fan having a stepped housing defined by an inlet part and an outlet part, the outlet part having the inside diameter smaller than the inside diameter of the inlet part, the inlet part adjoined to an inlet tube of an inside diameter substantially equal to the inside diameter of the outlet part of the housing. The outlet part of the housing accommodates a rotor having blades arranged such that their forward tips are located in the inlet part of the housing and a ferrule being secured at a certain distance from the inlet tube coaxially with the housing to form with the housing an annular chamber having on the side of the rotor an inlet passage and on the side of the inlet tube an outlet passage. Rigidly affixed in this chamber are guide vanes pointing by their heels to the inlet tube. The heels of the guide vanes extend to the inlet tube and are radially curved at a portion between the inlet tube and the ferrule to form an annular radial grill.

5 Claims, 2 Drawing Sheets

AXIAL-FLOW FAN

BACKGROUND OF THE INVENTION

This invention relates to fan engineering, and more particularly to axial-flow fans (one-stage, two-stage and multi-stage fans).

The invention can find application in designing axial-flow fans intended for ventilation and having stable pressure characteristics within a wide range of air or gas delivery.

Axial-flow fans find multiple applications in industry. A factor which hampers wide use is the appearance of stall flow at the periphery of the rotor blades resulting in considerable drop in head and pressure oscillations at reduced rates of air or gas delivery.

There is known an axial-flow fan featuring a wide range of stable operation (cf.,e.g. U.S. Pat. No. 3,189,260) which comprises a stepped casing having inlet and discharge portions. The diameter of the discharge portion is substantially smaller than the diameter of the inlet portion and the inlet portion accommodates a ferrule to form between the casing and the ferrule an annular passage for by-passing air flow during flow stalls. Guide vanes are provided in the ferrule. The discharge portion of the casing accommodates a rotor with a set of blades, forward tips of the blades being disposed in the inlet portion of the housing.

However, in this known fan the above annular passage is excessively extended in the axial direction, which results in increased longitudinal dimensions of the fan.

In addition, the guide vanes provided in the ferrule to straighten stalled flows increase aerodynamic resistance at the inlet portion of the casing before the rotor resulting in reduced head and efficiency of the fan.

Also known are axial-flow fans comprising a stepped housing having in the discharge portion thereof a rotor carrying a plurality of blades, the inlet portion of the housing including a ferrule defining with the housing an annular passage wherein there are affixed guide vanes to straighten the flow (cf., e.g., the West German Magazine H. D. Henssler Neue Axialventilatoren ohne instabilen Betriebsbereich, VGB Kraftwerkstechnik, 57 Jahrgang, Heft 3, März 1977, Seiten 159 bis 165).

In these fans the stalled flow at the outlet from the annular passage tends to partially block the inlet area to thereby hamper the passage of the main flow entering a flow-through zone before the rotor blades. Therefore, the amount of air delivered and the pressure in the flow stall areas are considerably reduced causing unstable operation.

There is further known an axial-flow fan generally similar to the one heretofore described and having guide vanes in an annular passage (cf. the pamphlet of "Licensintorg" "General-purpose Axial-flow Fan", Moscow, USSR).

An inlet tube is fixed to the inlet portion of the casing of the above fan, this inlet tube having an inner diameter substantially equal to the diameter of the diameter of the discharge portion of the casing and the guide vanes provided in the annular passage are confined by the axial dimensions of a ferrule.

The provision of the inlet tube improves to a certain extent the entry of the main air flow to the fan. However, due to the axially limited dimensions of the guide vanes, the stalled flow tends to retain a swirl conforming in direction to the direction of rotation of the rotor and, while exiting a flow-through area before the rotor blades, to hamper the stable passage of the main air flow. This causes reduced head and operating stability of the fan in flow stall conditions.

In view of the aforegoing, the provision of guide vanes in the annular passage in the known axial-flow fans fails to optimize head in flow stall conditions.

SUMMARY OF THE INVENTION

It is an object of this invention to increase the head at flow stall conditions and improve operating stability of the fan at these conditions.

Another object is to improve the efficiency of the axial-flow fan at flow stall operating conditions.

The objects and other attending advantages of the invention are attained by an axial-flow fan comprising a stepped housing made up of an inlet part and an outlet part, the outlet part having the inside diameter smaller than the inside diameter of the inlet part, the inlet part being adjoined to an inlet tube of a diameter substantially equal to the diameter of the outlet part of the housing, the outlet part of the housing accommodating a rotor having blades arranged such that their forward tips are located in the inlet part of the housing. A ferrule is provided at a certain distance from the inlet tube coaxialy with the housing to form therewith an annular chamber having on the side of the rotor an inlet passage and on the side of the inlet tube an outlet passage and having rigidly affixed therein guide vanes, the guide vanes pointing by their heels to the inlet tube. According to the invention, the heels of the guide vanes extend to the inlet tube and are radially curved at a portion between the inlet tube and the ferrule to form an annular radial grill.

Preferably, the heel of each guide vane is offset from the radial direction through an angle from −45° to +45°.

Such an offset of the heels of the guide vanes optimizes the head at low delivery rates of the fan.

Advisably, the ratio between the width of each guide vane and the width of the inlet passage of the annular chamber is from 2.0 to 3.0. The ratio between the width of the guide vane and the width of the outlet passage of the annular chamber is from 1.4 to 1.6, the ratio between the height of the guide vane to its width being preferably from 0.4 to 0.65.

Such ratios enable a reduction in aerodynamic losses during by-passing of the stall flow through the annular chamber, whereby the range of stable operation is expanded and efficiency of fan performance at low rates of air delivery is improved.

Preferably, the ratio between the inside diameter of the inlet tube and the diameter of the rotor in terms of blade ends is 1.00 to 1.01.

The above ratio acts to further improve the efficiency of the fan provided with the above described guide vanes.

Advisably, the ratio between the diameter of the ferrule and the outer diameter of the rotor blades is 1.01 to 1.05.

Such ratios between the diameters of the ferrule and the rotor provide for favourable passage of the flow through the flow-through portion of the fan toward the rotor to correspondingly improve the efficiency of the fan.

The axial-flow fan according to the invention, while being structurally simple, expands the range of stable operation and increases head and efficiency.

BRIEF DESCRIPTION OF THE DRAWINGS

The invention will now be described in greater detail with reference to preferred specific embodiments thereof taken in conjunction with the accompanying drawings, in which.

DETAILED DESCRIPTION OF THE INVENTION

Figure 1:
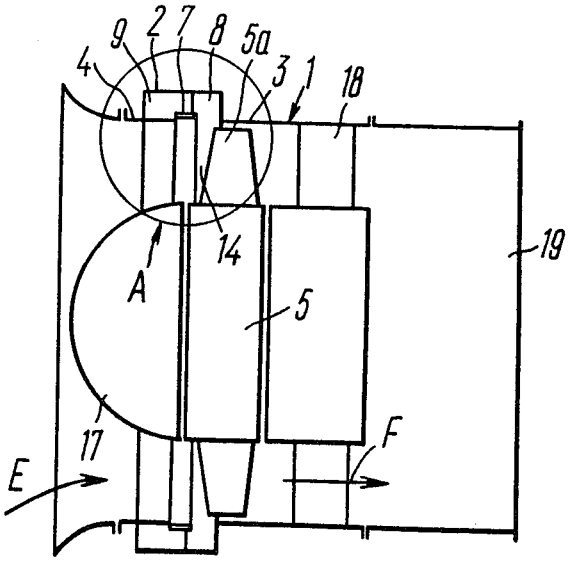
FIG. 1 is a side view of an axial-flow fan according to the invention.

With reference to FIG. 1, the axial-flow fan according to the invention comprises a stepped housing 1 made up of two parts: an inlet part 2 and an outlet part 3, the outlet part 3 having an inside diameter smaller than the diameter of the inlet part of the housing 1. An inlet tube 4 having a diameter substantially equal to the diameter of the outlet part 3 of the housing 1 is joined to the inlet part 2.

The outlet part 3 of the housing 1 accommodates a rotor 5 having blades 5*a*.

Figure 2:
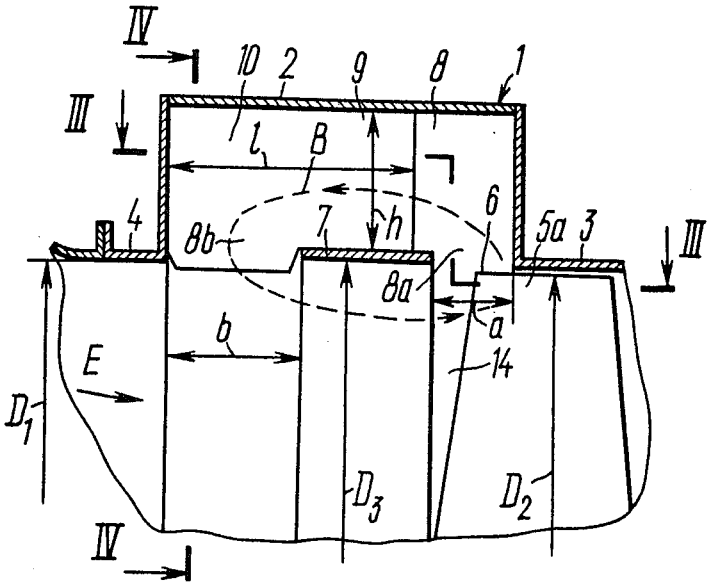
FIG. 2 is an enlarged side view, partly in section, of area A of FIG. 1.

The blades 5*a* are so aranged that their forward tips 6 (FIG. 2) are located in the inlet part 2 of the housing 1. Spaced a distance "b" from the inlet tube 4 of the inlet part 2 of the housing 1 coaxially therewith is a ring ferrule 7. The ring ferrule 7 and the inlet part 2 of the housing 1 define an annular chamber 8 to by-pass the stalled flow "B" of air.

The annular chamber 8 for by-passing the stalled flow "B" has an inlet passage 8*a* disposed between the blades 5*a* and the ferrule 7 and an outlet passage 8*b* disposed between the ferrule 7 and the inlet tube 4. These passages 8*a* and 8*b* are of the width "a" and "b", respectively.

Figure 3:
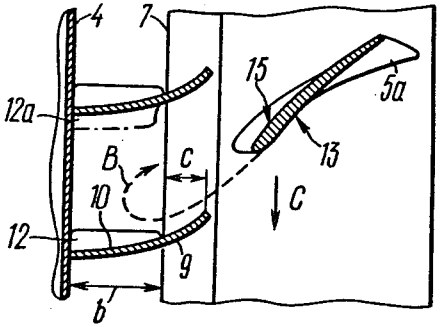
FIG. 3 is a section taken along the lines III—III in FIG. 2.

Guide vanes 9 are positioned in this annular chamber between the ferrule 7 and the inlet part 2 of the housing 1, heels 10 of the guide vanes 9 extending toward and terminating in the inlet tube 4. Between the ferrule 7 and the inlet tube 4 the heels 10 of the guide vanes 9 are radially curved, as seen best in FIGS. 3 and 4, to form an annular radial grill 11, a section of which is indicated by thin broken line in FIG. 4.

Figure 4:
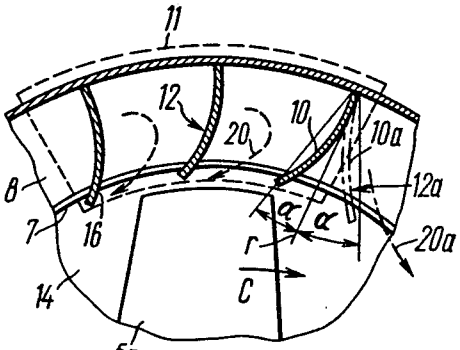
FIG. 4 is a cross section taken along the lines IV—IV in FIG. 2.

The heel 10 of each guide vane 9 is radially curved and offset from the radial direction "r" (FIG. 4) at an angle $\alpha$ ranging from $-45°$ to $+45°$. The positive value of the angle $\alpha$ corresponds to an offset of the heel 10 in a direction counter to the direction "C" of rotation of the blades 5*a*. These heels 10 are depicted in FIG. 4 by full lines. The negative value of the angle $\alpha$ corresponds to an offset of the heel 10*a*, shown by dash-dot lines, in a direction coinciding with the direction "C" of rotation of the blades 5*a*.

In order to increase fan head during flow stalls, it is necessary that the stalled flow "B" exiting the annular passage 8 (FIG. 2) through the outlet passage 8*b* extending between the ferrule 7 and the inlet tube 4 the distance "b" be swirled in a direction counter to the direction "C" of rotation of the blades 5*a* of the rotor 5. This can be effected due to the fact that the heel 10 of each guide vane 9 faces on its concave side 12 (FIG. 4) a pressure side 13 (FIG. 3) of the rotor blade 5*a* and is offset from the radial direction "r" through the angle $\alpha$ which is not in excess of $+45°$. Such an arrangement of the heels 10 of the guide vanes 9 directs the stall flow "B" (FIGS. 2, 3, 4) against the direction "C" of rotation of the rotor blades 5*a* and forces the swirled stall flow "B" (FIG. 2) toward the periphery of the flow-through portion 14 before the rotor blades 5*a* thus facilitating the passage of main flow "E" sucked in through the inlet tube 4 to result in a greater head produced by the fan.

In an alternative embodiment of the fan according to the invention, when it is necessary to reduce fan head at flow stall conditions, the stalled flow escaping from the annular chamber 8 through the outlet passage 8*b* is directed to conform to the direction "C" of rotation of the blades 5*a* of the rotor 5. This can be effected because the heels 10*a* (FIG. 4) of each guide vane 9 are adapted to face by their concave side 12*a* to a suction side 15 (FIG. 3) of the rotor blade 5*a* and are offset from the radial direction "r" through the angle $\alpha$ which is not in excess of $-45°$.

For more effective swirling of the stalled flow "B" the heels 10 and 10*a* (FIG. 4) with the concave sides 12 and 12*a* may radially project to a certain extent to the flow-through portion 14 by their edges 16 outside the inner diameter of the ferrule 7.

In addition, the ratios between the width "l" (FIG. 2) of the guide vane 9 and the width "a" of the passage 8*a* at the inlet to the annular chamber 8, and between the width "l" and the width "b" of the passage 8*b* at the outlet from the annular chamber 8 are $l/a=2.0-3.0$ and $l/b=1.4-1.6$, respectively; whereas the ratio between the height "h" of the guide vane 9 and its width "l" is $h/l=0.4-0.65$.

To improve the passage of the main flow "E" (FIG. 2) to the rotor blades 5*a*, a cowl 17 (FIG. 1) is provided inside the inlet tube 4. A flow straightener 18 is further provided to unswirl flow "F" escaping the rotor blades 5*a*, the flow straightener 18 being of any known suitable construction.

Optimally, the inside diameter $D_1$ (FIG. 2) of the inlet tube 4 ranges from 1.00 to 1.01 the outside diameter $D_2$ of the rotor blades 5*a*.

An increase in the value of the ratio $D_1/D_2$ of over 1.00–1.01 results in that the air flow "E" sucked in through the inlet tube 4 hampers outlet of the flow from the annular passage 8*b* thus affecting the fan performance. The preferable ratio ofthe inside diameter $D_3$ of the ferrule 7 to the diameter $D_2$ is from 1.01 to 1.05, which ratio optimizes the passage of air through the flow-through portion 14 before the rotor blades 5*a*.

The axial-flow fan according to the invention operates as follows.

When the rotor 5 with the blades 5*a* is rotated in the direction indicated by "C", the flow "E" being sucked in is caused to pass through the inlet tube 4 and the flow-through portion 14 to then pass between the blades 5*a* and the flow straightener 18 and exit therefrom as a substantially axal flow "F" providing head and air delivery in a duct 19 connected to the fan. As resistance to flow in the duct 19 grows, the amount of air delivered tends to decrease along with a head increase. At a rate of air delivery corresponding to the maximum head flow stall occurs at the periphery of the rotor blades 5*a;* the stalled flow "B" is thrown by centrifugal forces away from the forward tips 6 to be conveyed through the passage 8*a* to the annular passage 8 wherein at a portion having a width "c" (FIG. 3) it is axially unswirled or straightened to be thereafter at a portion having a width "b" deflected radially and swirled to escape to the flow-through portion 14. Due to the swirling, the stalled flow "B" is forced toward the periphery of the flow-through portion 14 thus failing to prevent the main flow "E" from being sucked in to result in head increase and more stable fan performance.

Figure 5:
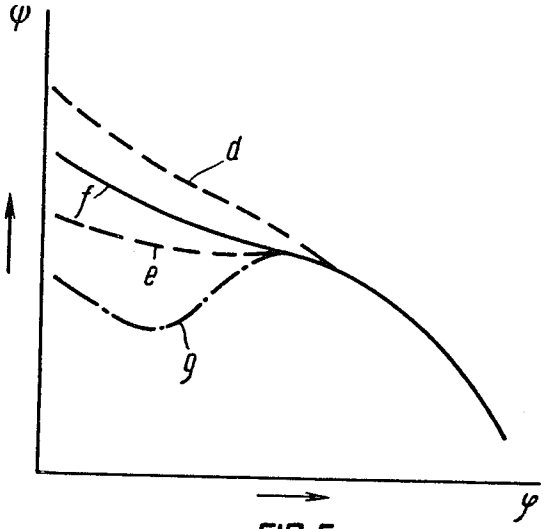
FIG. 5 shows a graph depicting the dependence between the head and the delivery rate.

If service conditions require that the fan head be increased at low delivery rate, then the heels 10 of the guide vanes 9 are deflected through the angle $\alpha$ of $+45°$ and the stalled flow "B" while passing through the outlet passage 8*b* from the annular chamber 8 is swirled in a direction 20 (FIG. 4) against the direction "C" of rotation of the rotor blades 5*a* to thereby increase head produced by the fan in the duct 19, as shown in FIG. 5 by the curve "d" in the coordinates: $\psi$-pressure and $\phi$-delivery.

In another application of the fan, when it is necessary to reduce head to low rates of air delivery, the heels 10*a* are deflected from the radial line "r" through the angle $\alpha$ up to $-45°$, whereby the stalled flow escaping from the passage 8*b* is swirled in a direction 20*a* coinciding with the direction "C" of rotation of the rotor blades 5*a,* which accordingly results in reduced head in the duct 19, cf. curve "e" in FIG. 5.

Curve "f" shows characteristic of the fan at low delivery when the heels of the guide vanes are deflected from the radial line "r" through a relatively small angle.

Curve "g" illustrates the delivery-head characteristic at flow stall conditions of the known axial-flow fan.

The axial-flow fan according to the invention enables a substantial increase in head, delivery, and efficiency of fan performance at flow stall conditions. In addition. the delivery-head characteristic at low rates of air or gas delivery may be varied depending on the conditions of service.

Figure 6:
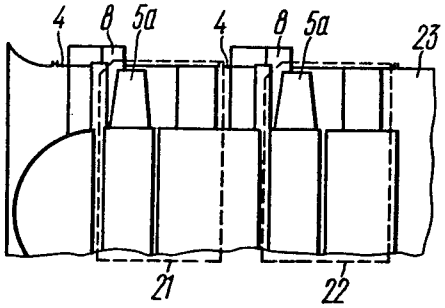
FIG. 6 is a side view of a two-stage axial-flow fan according to the invention.

For some applications requiring a greater head in the duct 19 use is made of two- or multi-stage modifications of the fan embodying the present invention, each of the stages 21 (FIG. 6) and 22 thereof being arranged similarly to what has been described with reference to the one-stage axial-flow fan hereinabove.

As resistance to flow at a maximum head in the duct 23 grows, the flow is stalled at the periphery of the blades 5*a,* but stable operation of the stages 21 and 22 will not be affected due to the effect of the annular radial grills 11 as was described above.

Otherwise, at reduced rates of air delivery and at a wide range of operating conditions the two-stage and multi-stage fans operate similarly to the one-stage axial-flow fan embodying the present invention.

The heretofore described modifications of the one-stage and two-stage axial-flow fans according to the invention provided with the annular chamber 8, ferrule 7 and annular radial grill 11 make it possible to considerably expand the operative range, increase the head and make fan performance more economical as compared with the known fans of similar types and to open wider possibilities for their industrial application.

What is claimed is:

1. An axial-flow fan comprising: a hollow housing having an inlet step and an outlet step, said outlet step having an inside diameter smaller than an inside diameter of said inlet step; an inlet tube adjoining said housing on a side of said inlet step and having an inside diameter substantially equal to an inside diameter of said outlet step through which a main flow of air passes; a ferrule disposed coaxially in said inlet step of said housing and spaced a specific distance from said inlet tube and forming an annular chamber between said ferrule and said inlet step of said housing; an outlet passage of said annular chamber disposed between said inlet tube and said ferrule; a rotor having blades disposed on an inner side of said inlet step of said housing and having an inlet passage of said annular chamber disposed between said rotor and said ferrule, said blades being arranged so that forward tips of said blades are disposed in said inlet step of said housing; guide vanes arranged in said annular chamber and rigidly affixed to said ferrule to facilitate passage of said main flow; and heels of said guide vanes pointing to and extending up to said inlet tube, said heels of said guide vanes being disposed between said inlet tube and said ferrule and being curved in a radial annular grill to direct stall flow against the rotation of said rotor.

2. An axial-flow fan as defined in claim 1 wherein said heels of said guide vanes are offset from the radial direction through an angle of from $-45°$ to $+45°$.

3. An axial-flow fan as defined in claim 1, wherein a ratio between a width of said guide vane and a width of said inlet passage of said annular chamber is from 2.0 to 3.0, and a ratio between a width of said guide vane and a width of said outlet passage of said annular chamber is from 1.4 to 1.6 and a ratio between a height of said guide vane and a width of said guide vane is 0.4 to 0.65.

4. An axial-flow fan as defined in claim 1, wherein a ratio between the inside diameter of said inlet tube and a diameter of said rotor at a blade end ranges from 1.00 to 1.01.

5. An axial-flow fan as defined in claim 1, wherein a ratio between a diameter of said ferrule and an outside diameter of a rotor blade is 1.01 to 1.05.

* * * * *